United States Patent [19]

Takao et al.

[11] Patent Number: 4,645,972

[45] Date of Patent: Feb. 24, 1987

[54] LOW PRESSURE DISCHARGE LAMP

[75] Inventors: Takeda Takao, Chigasaki; Yamazaki Hitoshi, Yokohama; Nakano Shizuo, Kamakura; Yamamoto Kouzi, Kanagawa; Ito Hiroshi, Megurohonmachi; Imai Jun, Hiratsuka, all of Japan

[73] Assignee: Mitsubishi Denki Kabushiki Kaisha, Tokyo, Japan

[21] Appl. No.: 708,081

[22] PCT Filed: Mar. 2, 1984

[86] PCT No.: PCT/JP84/00079

§ 371 Date: Feb. 26, 1985

§ 102(e) Date: Feb. 26, 1985

[87] PCT Pub. No.: WO85/04048

PCT Pub. Date: Sep. 12, 1985

[51] Int. Cl.[4] ..... H01J 61/34; H01J 61/70

[52] U.S. Cl. ..... 313/634; 313/493

[58] Field of Search ..... 313/493, 634, 609–611, 313/623–625

[56] References Cited

U.S. PATENT DOCUMENTS

| | | | |
|---|---|---|---|
| 4,199,708 | 4/1980 | Lauwerijssen et al. | 313/493 |
| 4,208,618 | 6/1980 | Heine | 313/573 X |
| 4,524,301 | 6/1985 | Cohen et al. | 313/493 |

*Primary Examiner*—Palmer C. DeMeo
*Assistant Examiner*—Sandra O'Shea
*Attorney, Agent, or Firm*—Oblon, Fisher, Spivak, McClelland & Maier

[57] ABSTRACT

A low pressure discharge lamp of double tube structure comprises an outer bulb containing therein a sealed gas and having one end closed and an inner tube supported by an end plate to communicate with the interior of the outer bulb; receiving therein an electrode and restricting an electric discharging path. The end receiving therein the electrode of the inner tube is bonded with an adhesive on the surface on the side facing the outer bulb of the end plate and a part of an end other than said end of said inner tube is in contact to and supported by the end plate. The construction makes bonding operations of the inner tube to the end plate easy and provide a stable condition to the inner tube in an lamp assemblage and reduces lamp weight.

5 Claims, 10 Drawing Figures

LOW PRESSURE DISCHARGE LAMP

TECHNICAL FIELD

The present invention relates to a low pressure discharge lamp having an inner tube to restrict a discharge path in an outer bulb forming a discharge space.

BACKGROUND ART

A variety of proposals have been made for this kind of discharge lamp to substitute it for an incandescent lamp because the discharge lamp allows its size-reduction into a compact form. The discharge lamp disclosed in Japanese Unexamined Patent Publication No. 44956/1982 is shown in FIG. 1 as an example, in which there are provided two electrodes 3 passing through an end plate 2 closing the lower opening portion of an outer bulb 1, extending in the outer bulb 1 and each one end of inner tubes 4, formed into a U-shape, is fitted to each projection 11 through which each of the electrodes 3 passes, on account of which cross-talk discharge possibly occurring between the electrodes 3 is prevented. The other open end of the inner tubes 4 is in contact with the upper surface of the end plate 2 and a recess 5 for causing bridge of electric discharge is formed in the vicinity of each of the open ends. On the other hand, the inner tubes 4 are held by a pressing plate 10 fitted to the upper end of a supporting rod 9 secured to the end plate 2 so that both the open ends are in contact with the end plate 2. A reference numeral 7 designates a layer of fluorescent material.

In the discharge lamp having the construction described above, since the supporting rod 9 and the pressing plate 10, both needed to secure the inner tubes 1 are incorporated in the lamp as additional parts, there are problems of increasing the number of parts; causing additional management for these parts, complicated structure of the lamp and increasing manufacturing steps.

SUMMARY OF THE INVENTION

It is an object of the present invention to provide a low pressure discharge lamp having double tube structure comprising an outer bulb and inner tubes, in which each open end part at the side of covering an electrode of the inner tubes is bonded with an adhesive to an end plate at a position facing the outer bulb and the other each open end part, which does not cover the electrode, of the inner tubes is made in contact with the end plate thereby eliminating problems of complicated management of parts; complicated manufacturing steps and increase in weight of the discharge lamp, all resulting from use of additional parts to secure the inner tubes, in view of the circumstances as described above.

It is another object of the present invention to provide a low pressure discharge lamp having double tube structure, in which an outer bulb, inner tubes and a fine pipe for air discharge are bonded with an adhesive on a surface of an end plate facing the outer bulb whereby manufacturing work can be simplified, damage of parts to be bonded or bonding portions can be prevented and reliability on airtightness can be increased.

BEST MODE OF CARRYING OUT THE INVENTION

Figure 1:
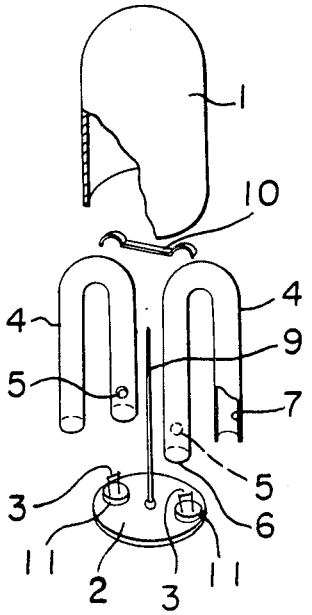
FIG. 1 is an exploded perspective view of a conventional low pressure discharge lamp in contrast to the present invention.

An embodiment of the present invention will be described with reference to FIG. 2.

A reference numeral 1 designates a cylindrical outer bulb made of glass having a domed top and an opened bottom and numeral 2 refers to an end plate made of metal or ceramics for closing the opened bottom of the outer bulb 1 to make it in airtight condition. There is enclosed a medium for discharge consisting of a predetermined amount of mercury and a rare gas such as argon in a sealed space formed by the end plate 2 and the outer bulb 1. Numeral 3 designates electrodes both being seal-bonded to the end plate 2 to extend into the outer bulb 1 and a numeral 4 indicates an inner tube made of glass which is to be arranged in the outer bulb 1 to restrict a discharge path. The inner tube 4 is formed in one piece by melt-bonding each of legs of two glass tubes bended to be a U-shape. Namely, free ends of the inner tube 4 are bonded with an adhesive of glass frit 8 to a surface of the end plate 2 in an air-tight fashion to respectively cover the electrodes 3, 3 so that no cross-talk electric discharge takes place between the electrodes 3, 3. On the other hand, the other ends of the inner tube 4 is bridged by forming therebetween a connecting part 6 by melt-bonding the vicinity of the open ends 5 of the two U-shaped glass tubes so that the end part thus connected is brought to in contact with the surface of the end plate 2. A substantially semi-circular opening 5 formed by obliquely cutting the glass tube from its open end is provided in each side portion of the glass tubes facing each other.

Simple explanation will be made as to assembling work for the embodiment shown in FIG. 2.

First of all, an adhesive 8 is previously applied to on the end plate 2.

A single inner tube having two U-shaped parts formed in one piece by connecting part 6 is set up on the surface of the end plate 2 with its four lower surfaces without any supporting aid. Then, the outer bulb 1 is sealed by the end plate 2.

In the assembling work as above-mentioned, it is unnecessary to use a jig (not shown) for supporting the inner tube for the purpose of bonding the inner tube 4 to the end plate 2 with the adhesive of glass frit 8, as required in the conventional processes to secure an inner tube 4 consisting of a single U-shaped glass tube, whereby the assembling work can be remarkably simplified. Further, since the four end surfaces of the inner tube 4 are all in contact with the end plate surface, it is rare that the inner tube falls down even though an impact force is applied to a incomplete lamp in the later stage of the assembling work or a completed lamp.

Incidentally, since the inner tube supporting rod as shown in FIG. 1 is not required because the inner tube 4 is attached by bonding operation, the number of parts needed can be reduced, hence the number of the manufacturing steps can be reduced and accordingly, management for the parts is easy and manufacturing process is simplified.

The supporting rod 9 and the pressing plate 10 used in the conventional lamp as shown in FIG. 1 have been made of metal. In the discharge lamp of this kind which is required to reduce its weight for the purpose of substituting the discharge lamp for an incandescent lamp, if the supporting rod 9 and the pressing plate 10 can be eliminated, the total weight of the lamp can be reduced.

Figure 3:
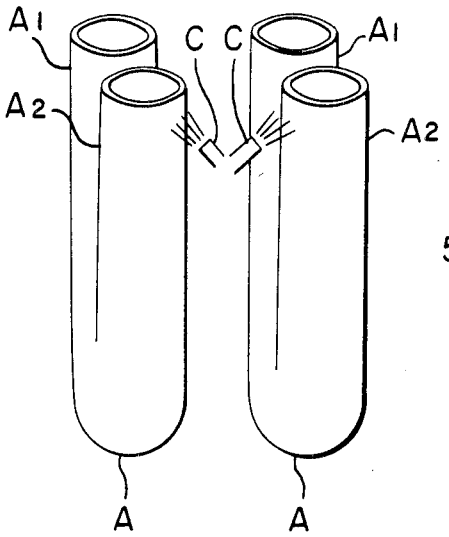
FIG. 3 is a diagram showing the preparation of an inner tube shown in FIG. 2.
Figure 4:
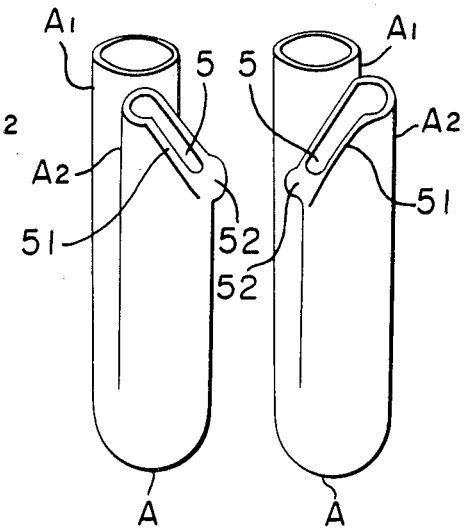
FIG. 4 is a diagram showing the preparation of the inner tube in FIG. 2.
Figure 5:
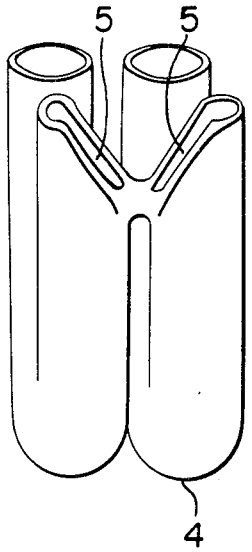
FIG. 5 is a diagram showing the preparation of the inner tube in FIG. 2.

In the next place, a method of preparation of the inner tube 4 of the embodiment shown in FIG. 2 will be described. The inner tube 4 is prepared according to steps as shown in FIGS. 3 to 5. Two glass tubes A, A each having a U-shaped portion are placed in juxta position with respect to two legs $A_1$, $A_1$ and $A_2$, $A_2$ facing each other and with their open ends directing upwards; the upper portions of the respective legs $A_2$, $A_2$ are simultaneously heated by a burner C from the open end to the just lower portion to cause them to be molten; after a short time period, a part of the top of the respective legs $A_2$, $A_2$ deforms due to wind pressure of the flame from the burner C to form a semi-circular opening 5 as if cut obliquely from the open end and a mass of molten glass 52 is formed at the peripheral portion 51 of the opening 5 as shown in FIG. 4. The molten glass mass formed at the lower part of the peripheral portion, but at the upper part when the inner tube 4 is set up on the end plate 2 is pinched and the molten glass mass of both the glass tubes A, A are brought into contact each other; then, the glass tubes A, A are slightly apart from each other to form a connecting part 6; thus the preparation of the inner tube 4 is completed as shown in FIG. 5. It is advantageous that a fluorescent layer 7 to be coated on the inner wall of the inner tube 4 is formed after the preparation of the inner tube 4 because the connecting part 6 can be easily formed. In the discharge lamp of the present invention, since the connecting part 6 is formed at the same time of formation of the opening 5 as a recess to cause a bridge of electric discharge when the inner tube 4 is to be prepared, the number of steps for heating and annealing the glass tube are reduced.

The shape of the opening 5 to be formed in the inner tube 4 is not limited to a semi-circular one which is formed by obliquely cutting the leg from the open end, but can be a circular shape which may be formed at the intermediate of the leg of the inner tube 4. In this case, the circular opening 5 can be obtained by blowing a flame oliquely from the outside at a high temperature such as oxygen gas flame at a position where an opening is to be formed in the leg.

The shape of the inner tube 4 is variable; for example, the inner tube is formed in such a manner that a glass tube in a U-shape is again subjected to bending operation into a saddle shape to form a plurality of U-shaped portions. Then, the electrodes are covered by the respective ends of the glass tube and the lower side surfaces of the plurality of U-shaped portions are brought into contact with the end plate.

It is considered that in addition to the inner tube bonded to the end plate with an adhesive, the outer bulb and the fine tube for air discharge are also bonded to the end plate with an adhesive. In this case, bonding operations are carried out by putting an adhesive of glass frit in either a molded form or paste on predetermined portions; putting a body to be bonded such as an outer bulb on the glass frit or directly putting the body on, for example, the end plate, followed by coating a paste-like glass frit around the contacting area of the body, and then applying heat to the glass frit until the glass frit reaches a predetermined temperature for melt-bonding.

In the discharge lamp having many portions to be bonded with an adhesive such as glass frit, it is essential to reduce the number of bonding operations to simplify manufacturing work. Further, when the inner tube, the outer bulb and the fine tube for air discharge are separately bonded, a part having been bonded or bonding portion may be broken or air-tight property may be impaired due to thermal stress caused by application of heat in the bonding operations conducted later.

Figure 6:
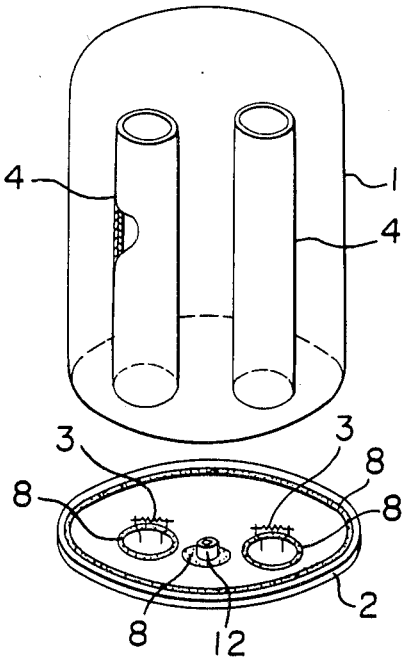
FIG. 6 is an exploded perspective view of another embodiment of the low pressure discharge lamp according to the present invention.

As measures to solve such drawback, there is another embodiment of the present invention which will be described with referece to FIG. 6 and 7. In FIG. 6, the same reference numerals as in FIG. 2 designate the same or corresponding parts and therefore, the description is omitted.

FIG. 6 shows a discharge lamp in which there are provided two inner tubes 4 each having an upper open end and the lower end bonded to the end plate 2 with an adhesive 8 such as glass frit and each enlosing therein an electrode 3. The reference numeral 12 designates a fine tube for air discharge which has one end communicated with the interior of the outer bulb 1 for the purpose of evacuation of air. The fine tube 12 is fitted into an insertion hole 21 for fine tube formed in the end plate 2 as shown in FIG. 7.

The construction of the end plate 2 will be described in more detail with reference to FIG. 7.

The insertion hole 21 for fine tube is provided between the electrode 3, 3 in the end plate 2 and a recess 22 having relatively large diameter is formed in the surface at the side of the electrodes, of the end plate 2. Annular grooves 23 are formed around the electrodes 3 in the end plate 2 so as to have a diameter corresponding to the inner tube 4. Separate annular grooves 24 are formed near the edge of the end plate 2 on the same side as the annular grooves 23 as above-mentioned so as to have a diameter corresponding to the outer bulb 1. In these grooves 22, 23 and 24, the adhesive 8 of glass frit is applied.

Assembling operations for the discharge lamp having the construction described above will be explained.

First of all, the adhesive 8 of paste-like glass frit is applied to each of the grooves 22, 23 and 24 in the end plate 2. An end part of the fine tube 7 for air discharge is inserted into the insertion hole 21 for fine tube. The inner tube 4 is put on the glass frit 8 in the groove 23. In the same manner, the outer bulb 1 is put on the adhesive 8 in the groove 24. Thus combined product is subject to preliminary drying and then it is passed through a heat oven to cause melt-bonding of the adhesive 8 of glass frit followed by solidification; thus, the bonding operation is completed.

Since the grooves 22, 23 and 24 to which the outer bulb 1, the inner tube 4 and the fine tube 12 for air discharge are bonded are all provided on the single surface of the end plate 2, which faces the outer bulb 1, the assembling work such as application of the adhesive 8 of glass frit, putting or inserting the outer bulb (1), the inner tube 4 and the fine tube 12 and so on are all carried out on the same surface side without requirement of necessity of separate operations for the outer bulb (1) or the inner tube 4 etc. In this way, the assembling operation is simplified.

It is known that when a glass frit as an adhesive is heated, it becomes molten state to exhibit fluidity. In the present invention, however, since the grooves 22, 23, 24 to which the glass frit is applied are formed in the same surface of the end plate 2, there is no risk of flowing the glass frit from any of grooves 22, 23, 24.

In the embodiment, it is unnecessary to separately carry out bonding operations on account of which a part having been bonded is not damaged due to thermal stress caused by bonding operations to the other part and excellent mechanical strength and air-tight property can be obtained.

Description will be made as to another embodiment of the present invention.

Figure 7:
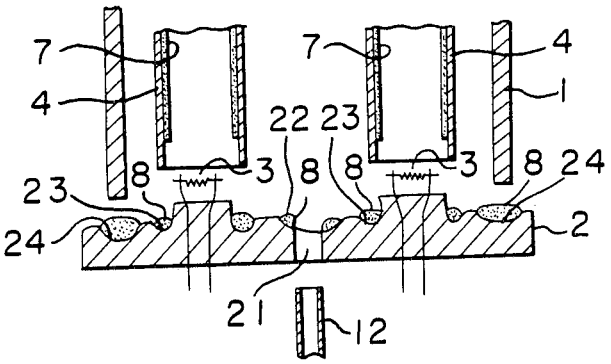
FIG. 7 is a cross sectional view partly omitted of the other embodiment of the discharge lamp of the present invention.
Figure 8:
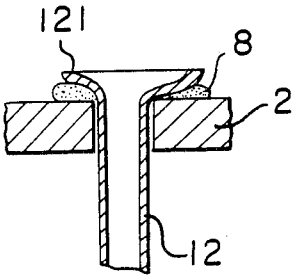
FIG. 8 is a cross sectional view of an important part of still another embodiment of the present invention.
Figure 9:
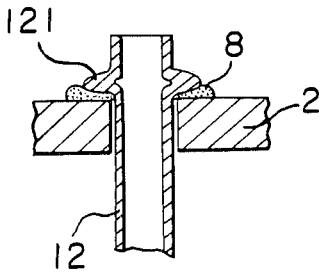
FIG. 9 is a cross sectional view showing another embodiment of the present invention.

Although the fine tube 7 for air discharge of generally cylindrical shape is used in the embodiment as shown in FIGS. 6 and 7, it can be one which has an external flange 121 at one end of the fine tube which extends in the outer bulb 1 as shown in FIGS. 8 and 9. This structure of the fine tube 12 eliminates an auxiliary means to support the fine tube 12 for air discharge.

Figure 10:
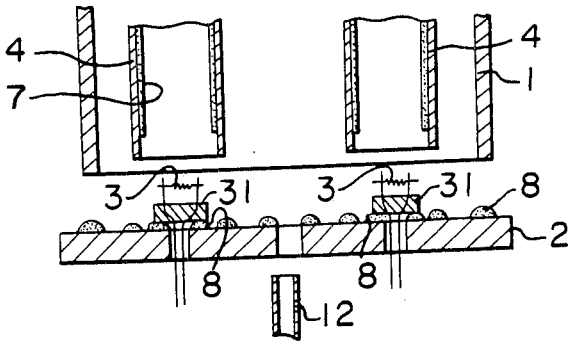
FIG. 10 is a cross sectional view of a separate embodiment of the discharge lamp of the present invention.

For a separate embodiment of the construction for the electrodes 3, 3 and the end plate 2, it is possible, as shown in FIG. 10, to provide supporters 31, 31 made of glass or ceramics to support the electrodes 3, 3 and bond the supporters 31, 31 with the glass frit on the end plate surface facing the outer bulb as with the other elements. Further, it is always unnecessary to apply the glass frit in the grooves 22, 23, 24 as shown in FIG. 10.

Use of the glass frit as an adhesive is made not only in paste form as described above but also in a predetermined molded form to a part or the entire portion of the end plate 2.

Figure 2:
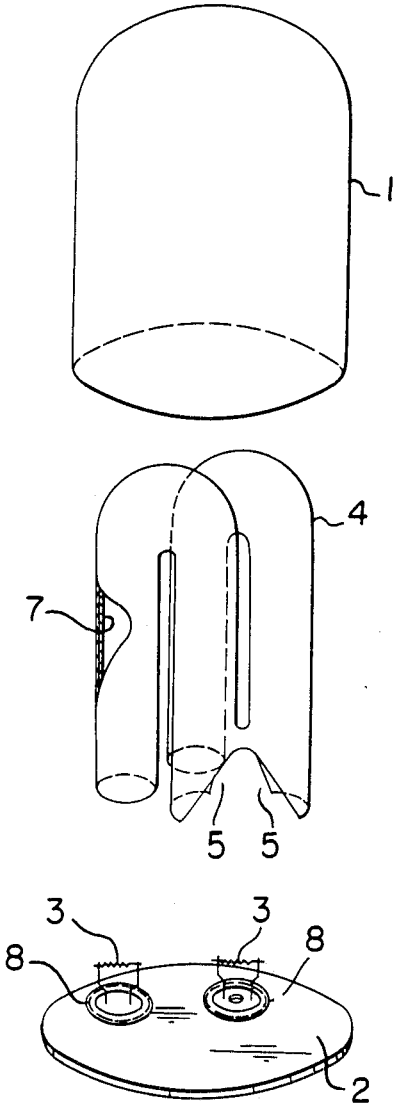
FIG. 2 is an exploded perspective view of an embodiment of the low pressure discharge lamp according to the present invention.

In the embodiments shown in FIGS. 6 to 10, it is, of course, possible to use the inner tube 4 in which two U-shaped glass tubes are combined into one piece as shown in FIG. 2, or in which a single U-shaped tube is bent into a saddle form.

We claim:

1. A low pressure discharge lamp of double tube construction comprising:

an outer bulb containing one open end with the remainder of the bulb being completely closed;

an end plate placed in sealing relationship with the open end of said outer bulb;

a plurality of electrodes mounted on said end plate and sealed thereto;

a gas contained within the volume defined by said outer bulb and said end plate;

an inner tube including a plurality of light transmitting tubes, each having an open end which receives therein one of said electrodes and which is adhesively bonded to and supported by the surface of said end plate;

each of said light transmitting tubes restricting an electric discharging path;

each of said light transmitting tubes having at least one opening in communication with said volume and having a part of an end other than said open end in contact with and supported by said end plate;

said tubes being connected to each other by melt-bonding at a part of the edge portion of said opening.

2. A low pressure discharge lamp of double tube construction comprising:

an outer bulb containing one open end with the remainder of the bulb being completely closed;

an end plate being adhesively bonded to the open end of said outer bulb;

a plurality of electrodes mounted on said end plate and sealed thereto;

a gas contained within the volume defined by said outer bulb and said end plate;

an inner tube having an open end which receives therein one of said electrodes and which is adhesively bonded to and supported by the surface of said end plate;

said inner tube restricting an electric discharging path;

said inner tube having a part of an end other than said open end in contact with and supported by said end plate where said part of an end other than said open end is open in communication with said volume; and a fine tube for air discharge being adhesively bonded to said end plate.

3. The low pressure discharge lamp according to claim 2, wherein said inner tube, outer bulb and fine tube for air discharge are bonded with an adhesive at respective grooves formed in said end plate.

4. A low pressure discharge lamp of double tube construction comprising:

an outer bulb containing one open end with the remainder of the bulb being completely closed;

an end plate being adhesively bonded to the open end of said outer bulb;

a plurality of electrodes mounted on said end plate and sealed thereto;

a gas contained wihin the volume defined by said outer bulb and said end plate;

an inner tube having an open end which receives therein one of said electrodes and which is adhesively bonded to and supported by the surface of said end plate;

said inner tube restricting an electric discharging path;

said inner tube being in communication with said volume; and a fine tube for air discharge having a flange formed at an end portion extending into said outer bulb and being adhesively bonded to said end plate.

5. A low pressure discharge lamp of double tube construction comprising:

an outer bulb containing one open end with the remainder of the bulb being completely closed;

an end plate being adhesively bonded to the open end of said outer bulb;

a plurality of electrodes mounted on said end plate and being adhesively bonded thereto through an electrode supporter;

a gas contained within the volume defined by said outer bulb and said end plate;

an inner tube having an open end which receives therein one of said electrodes and which is adhesively bonded to and supported by the surface of said end plate;

said inner tube restricting an electric discharging path;

said inner tube being in communication with said volume; and a fine tube for air discharge being adhesively bonded to said end plate.

* * * * *